United States Patent [19]

Lo

[11] Patent Number: 4,934,688

[45] Date of Patent: Jun. 19, 1990

[54] WIND-DRAG TYPE CLIMBER

[76] Inventor: Peter K. Lo, P.O. Box 13-124, Taipei, Taiwan

[21] Appl. No.: 468,056

[22] Filed: Jan. 22, 1990

[51] Int. Cl.[5] ..... A63B 23/04

[52] U.S. Cl. ..... 272/70; 272/130; 272/96

[58] Field of Search ..... 272/69, 70, 71, 72, 272/73, 96, 97, 128, 130, 135

[56] References Cited

U.S. PATENT DOCUMENTS

| | | | |
|---|---|---|---|
| 3,704,886 | 12/1972 | Kay et al. | 272/73 |
| 4,708,338 | 11/1987 | Potts | 272/69 |
| 4,720,093 | 1/1988 | Del Mar | 272/70 |
| 4,838,543 | 6/1989 | Armstrong et al. | 272/70 |

*Primary Examiner*—Stephen R. Crow

[57] ABSTRACT

A wind-drag type climber includes a base frame, a suspended wheel, a handlebar assembly, two swing arms each carrying a pedal thereon, a driving shaft, and a speed-increasing mechanism interconnecting the wheel and the driving shaft so as to rotate the wheel at a speed greater than that of the driving shaft. The wheel has a plurality of generally radially extending wheel blades which create air impedance to the rotation of the wheel. A drawing member is fastened to the free ends of the swing arms at two ends thereof and has two chain-like sections engaged with the two sprockets of the driving shaft, and a cable-like section extending around two aligned lower pulleys. The sprockets are sleeved rotatably on the driving shaft by unidirectional bearings. Each of the bearings locks the corresponding sprocket on the driving shaft only when the corresponding sprocket rotates in a predetermined direction. A flexible reciprocating element extends around an upper pulley and is fastened to the free ends of the swing arms at two ends thereof.

3 Claims, 6 Drawing Sheets

WIND-DRAG TYPE CLIMBER

BACKGROUND OF THIS INVENTION

This invention relates to a climber, more particularly to a wind-drag type climber for exercise purposes.

Referring to FIG. 1, a conventional climber includes a pulley 1A, a drawing member 2A, a pair of swing arms 3A with pedals, a pair of air cylinders 4A and a base frame 5A. The drawing member 2A is fastened to the swing arms 3A at two ends thereof and extends around the pulley 1A. When either of the pedals is moved downward, another of the pedals is pulled upward by the drawing member 2A. The conventional climber suffers from the following drawbacks: (1) Continuous reciprocation of the drawing member 2A easily damages the pulley 1A. (2) No resistance adjustment device is provided on the climber for the purpose of offering variable resistance to the actuation of the pedals. (3) The exercise effect of the climber is limited. To increase the exercise effect, disclosed is a wind-drag type climber in copending U.S. Pat. application Ser. No. 07/430,784.

SUMMARY OF THE INVENTION

An object of this invention is to provide a climber in which the pull of the drawing member interconnecting the pedals does not concentrate on a pulley.

Another object of this invention is to provide a climber with a resistance adjustment device.

According to this invention, a climber includes a base frame and a handlebar assembly for gripping purposes fixed on the base frame. A horizontal driving shaft is journalled on the base frame and includes a left sprocket and a right sprocket which are sleeved rotatably on said driving shaft. Each of the left and right sprockets is equipped with a unidirectional bearing for locking the corresponding sprocket on the driving shaft only when the corresponding sprocket rotates in a predetermined direction. Two swing arms are mounted pivotally on the base frame and respectively carry a pedal on the free end thereof, in such a manner that the swing arms can rotate about a horizontal axis. Two aligned first pulleys are disposed on the base frame in such a manner that each of the first pulleys can rotate about a horizontal axis and that the rotating axes of the first pulleys are perpendicular to the rotating axis of the driving shaft. A drawing member is fastened to the pedals at two ends thereof and has two chain-like sections respectively engaged with the left and right sprockets, and a cable-like section extending around the first pulleys. The cable-like section is connected rotatably to the chain-like sections. The arrangement of the drawing member can convert the reciprocation of the swing arms into the rotation of the left and right sprockets, thereby rotating the driving shaft in the predetermined direction. The first pulleys guide the drawing member to reciprocate along a generally U-shaped path. A second pulley is disposed on the base frame between the swing arms. A flexible reciprocating element is fastened to the pedals at two ends thereof and extends around the second pulley so that the downward movement of either of the pedals can move the other pedal upward. A wheel axle is journalled on the base frame. A wheel body is sleeved rigidly on the wheel axle and has a plurality of generally radially extending wheel blades, which create air impedance to the rotation of the wheel body. A speed-increasing mechanism interconnects the wheel axle and the driving shaft so as to rotate the wheel axle at a speed greater than that of the driving shaft.

BRIEF DESCRIPTION OF THE DRAWING

Other features and advantages of this invention will become apparent in the following detailed description of a preferred embodiment of this invention, with reference to the accompanying drawings in which.

DETAILED DESCRIPTION OF THE PREFERRED EMBODIMENT

Figure 1:
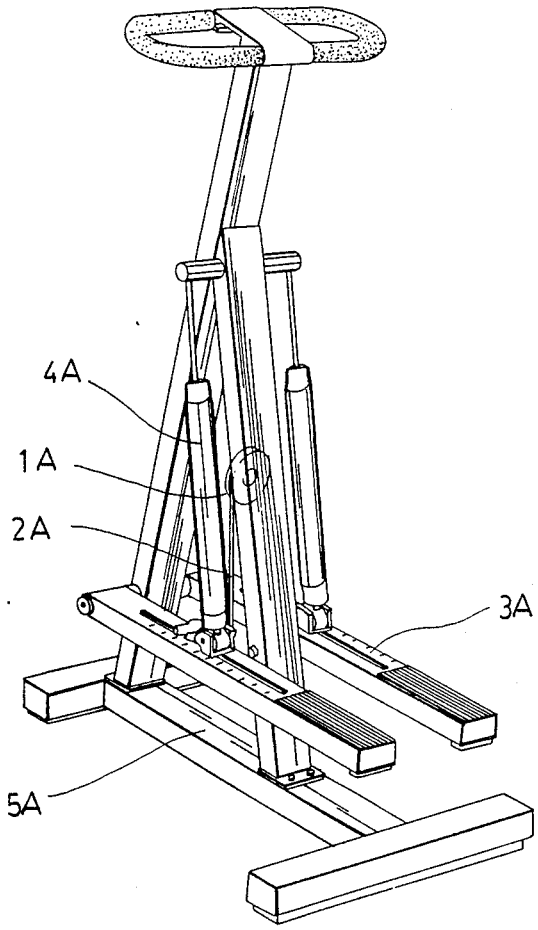
FIG.1 PRIOR ART
FIG. 1 is a perspective view of a conventional climber.

Referring to FIGS. 2–5, a wind-drag type climber of this invention includes a base frame 10, a handlebar supporting frame 20, a driving shaft assembly 30, a driven shaft assembly 40, a pair of swing arms 50, a suspended wheel assembly 60 and a resistance adjustment device 70.

The base frame 10 includes a main frame 11, a wheel supporting frame 12, and a pair of parallel connecting rods 13 interconnecting the main frame 11 and the wheel supporting frame 12. An upper pulley 111 is disposed on the upper end portion 11*a* of the main frame 11. A reciprocating element or cable 113 extends around the upper pulley 111. A pair of aligned lower pulleys 112 are disposed on the base frame 10 in front of the lower end portion 11*b* of the main frame 11. The cable-like portion 114 of a drawing member (D), which is indicated by the solid lines, extends around the lower pulleys 112. A generally C-shaped handle element 21 is disposed on the upper end of the handlebar supporting frame 20.

Figure 7:
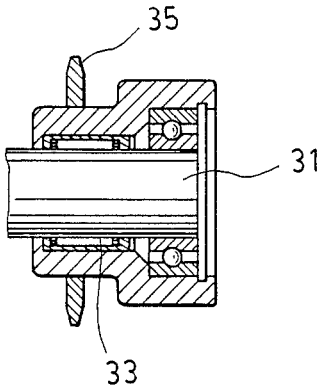
FIG. 7 is a schematic view illustrating the unidirectional bearing of the wind-drag type climber according to this invention.

The driving shaft assembly 30 includes a driving shaft 31 journalled on two bearing plates 32 (see Fig. 2) which are respectively disposed on the connecting rods 13. A left sprocket 34 and a right sprocket 35 are sleeved rotatably on the driving shaft 31 by means of two unidirectional bearings 33 (see FIGS. 4 and 7). Each of the unidirectional bearings 33 locks the corresponding sprocket 34, 35 on the driving shaft 31 only when the corresponding sprocket 34, 35 rotates in a predetermined direction. A driving sprocket 36 is sleeved rigidly on the driving shaft 31. An endless chain 361 is engaged with the links of the driving sprocket 36.

Figure 6:
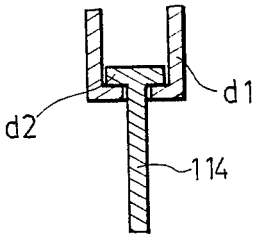
FIG. 6 is a schematic view illustrating interconnection of the cable-like section and the chain-like sections of the drawing member in accordance with this invention.
Figure 5:
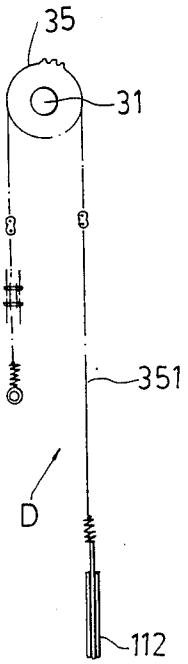
FIG. 5 is a schematic view illustrating the arrangement of the drawing member of the wind-drag type climber according to this invention.

The chain-like sections 341, 351 of the drawing member (D), which are indicated by the phantom lines, are respectively engaged with the links of the left sprocket 34 and the right sprocket 35. Each of the chain-like sections 341, 351 includes a hollow, metal cylinder d1 (see FIG. 6) secured to the lower end thereof. The cable-like section 114 of the drawing member (D) extends through the central hole in the bottom wall of the cylinder d1 and has an upper end d2 with an increased diameter which prevents the cable-like section 114 from moving downward out of the cylinder d1.

Figure 2:
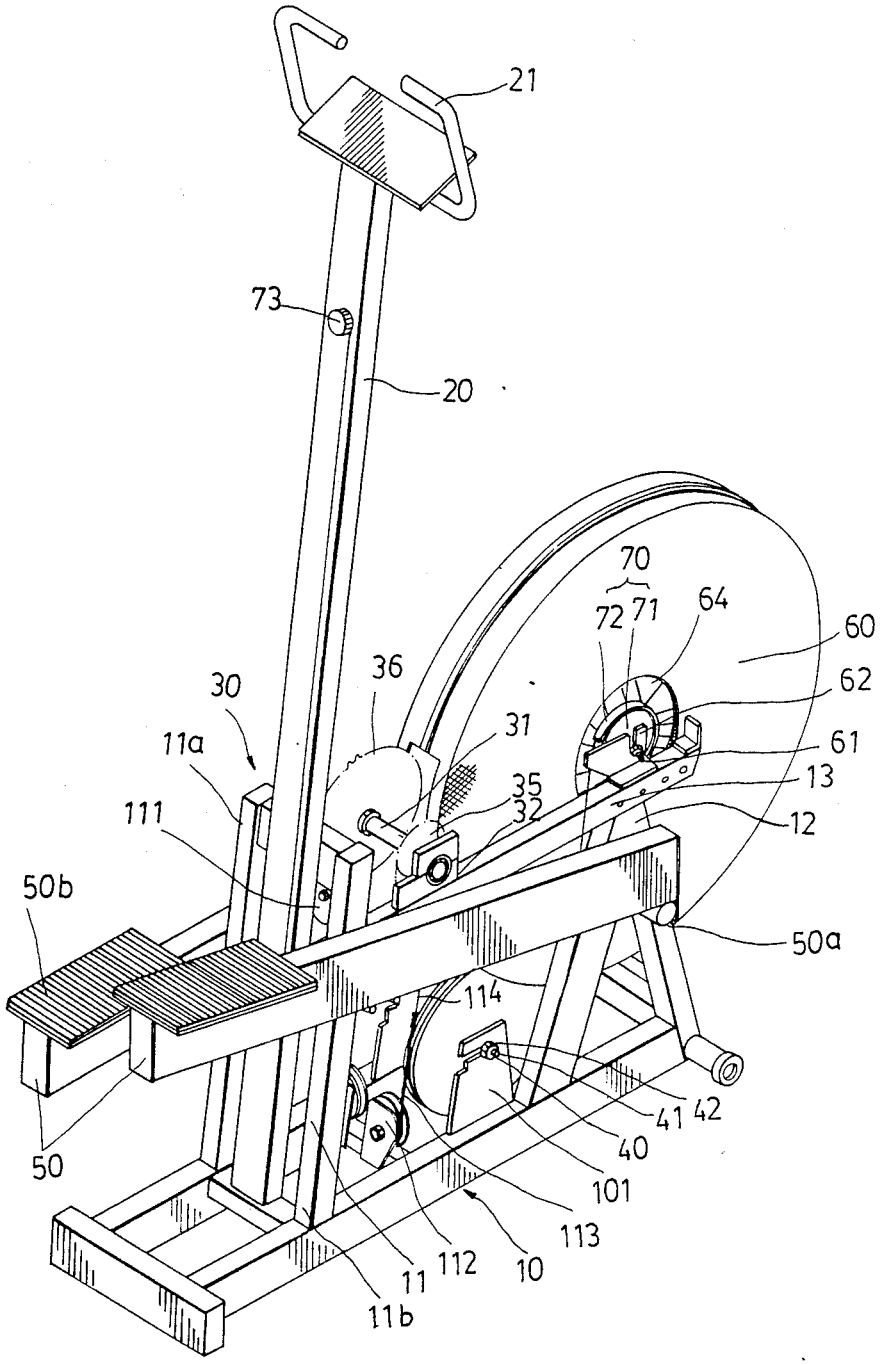
FIG. 2 is a perspective view of a wind-drag type climber according to this invention.
Figure 3:
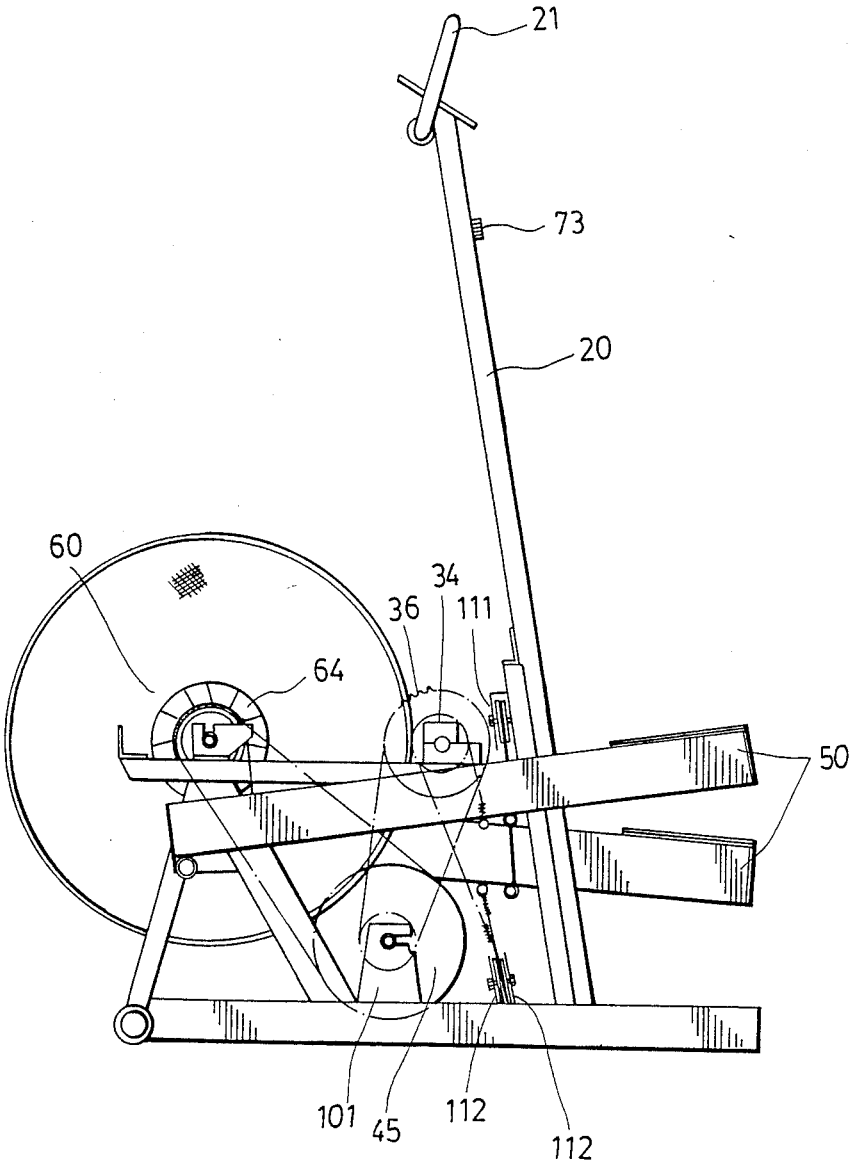
FIG. 3 is a side view showing the wind-drag type climber of this invention.
Figure 4:
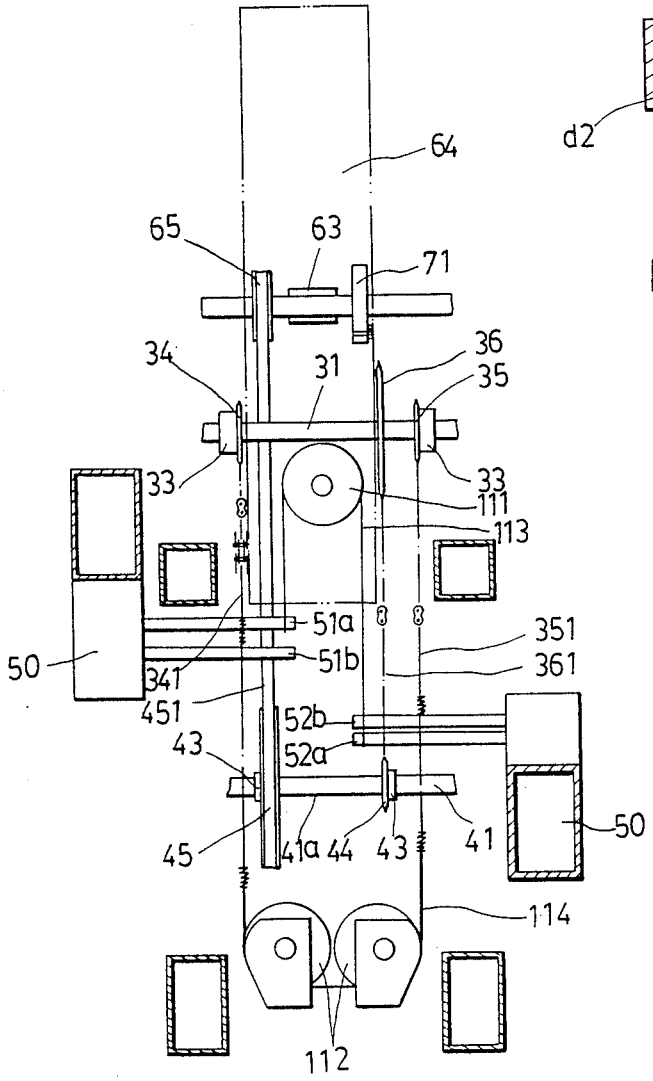
FIG. 4 is a schematic view illustrating the wind-drag type climber of this invention.

Referring to FIGS. 2 and 4, the driven shaft assembly 40 includes a fixed shaft 41 fixed on two supporting plates 101 of the base frame 10. A driven shaft 41*a* is sleeved rotatably on the fixed shaft 41 by means of two bearings 43, which are provided within two bearing blocks 42. A driven sprocket 44 is sleeved rigidly on the driven shaft 41*a* and engaged with the endless chain 361. The diameter of the driven sprocket 44 is smaller than that of the driving sprocket 36 so that the driven shaft 41*a* can rotate at a speed greater than that of the driving shaft 31. A driving belt pulley 45 is sleeved rigidly on the driven shaft 41*a*. A V-belt 451 extends around the driving belt pulley 45.

The swing arms 50 are mounted rotatably on the base frame 10 by a pivot pin 50*a* and respectively carry pedals 50*b* on the free ends thereof. Each of the pedals 50*b* includes two parallel fastening rods 51*a*, 51*b*, and 52*a*, 52*b* extending inwardly therefrom. Two ends of the reciprocating element 113 are respectively fastened to the fastening rods 51*a*, 52*a* of the pedals 50*b*, so that the downward movement of either of the pedals 50*b* moves the other pedal 50*b* upward. Two cable-like ends of the drawing member (D) are respectively fastened to the fastening rods 51*b*, 52*b* of the pedals 50*b*. Accordingly, the reciprocation of the pedals 50*b* rotates the left sprocket 34 and the right sprocket 35 in alternate clockwise and counterclockwise directions. When this happens, with the unidirectional bearings 33 interposed between the driving shaft 31 and the left and right sprockets 34, 35, the two-directional rotation of the left sprocket 34 and the right sprocket 35 is converted into the unidirectional rotation of the driving shaft 31.

With the drawing member (D) interconnecting the pedals 50*b*, the lifetime of the upper pulley 111 is increased in comparison with the conventional pulley 1A shown in FIG. 1.

Figure 8:
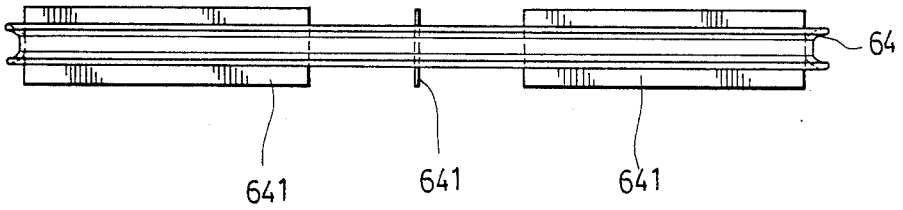
FIG. 8 is a schematic view illustrating the wheel blades of the wheel body of the wind-drag type climber according to this invention.

The suspended wheel assembly 60 includes a wheel axle 61 journalled on the bearing plates 62 of the wheel supporting frame 12, a hub 63 sleeved rigidly on the wheel axle 61, a suspended wheel body 64 sleeved rigidly on the hub 63, and a driven belt pulley 65 sleeved rigidly on the wheel axle 61. The diameter of the driven belt pulley 65 is smaller than that of the driving belt pulley 45 so that the wheel axle 61 can rotate at a speed greater than that of the driven shaft 41*a*. As shown in FIG. 8, the wheel body 64 has a plurality of generally radially extending wheel blades 641 which create air impedance to the rotation of the wheel body 64. The higher the rotational speed of the wheel body 64, the greater air impedance to the rotation of the wheel body 64.

Figure 9:
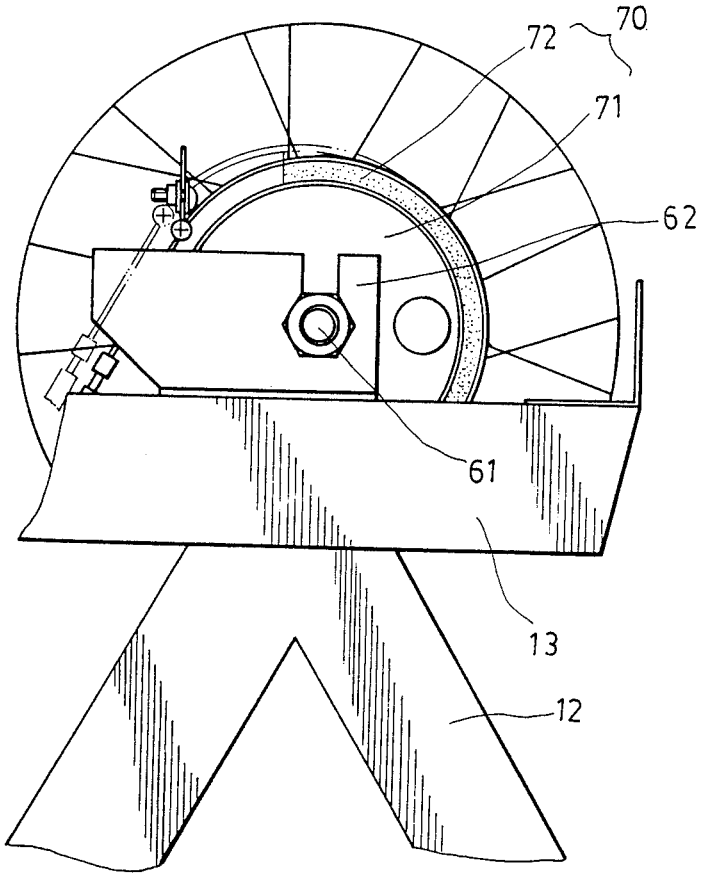
FIG. 9 is a side view showing the resistance adjustment device of the wind-drag type climber according to this invention.

Referring to FIG. 9, the resistance adjustment device 70 includes a small wheel 71 sleeved rigidly on the wheel axle 61, a friction ring 72 sleeved movably on the small wheel 71, and a control unit 73 disposed on the handlebar supporting frame 20. The control unit 73 can be actuated manually so as to adjust the pressure of the friction ring 72 against the circumferential surface of the small wheel 71.

With this invention thus explained, it is apparent that numerous modifications and variations can be made without departing from the scope and spirit of this invention. It is therefore intended that this invention be limited only as indicated in the appended claims.

I claim:

1. A climber comprising:

a base frame;

a handlebar assembly fixed on said base frame so that a user can grip thereon;

a horizontal driving shaft, journalled on said base frame, including a left sprocket and a right sprocket which are sleeved rotatably on said driving shaft, each of said left and right sprockets being equipped with a unidirectional bearing for locking a corresponding said sprocket on said driving shaft only when said corresponding sprocket rotates in a predetermined direction;

two swing arms mounted pivotally on said base frame at one end thereof, each of said swing arms carrying a pedal on the other end thereof in such a manner that said swing arms can rotate about a horizontal axis;

two aligned first pulleys disposed on said base frame in such a manner that each of said first pulleys can rotate about a horizontal axis and that said axes of said first pulleys are perpendicular to the axis of said driving shaft;

a drawing member fastened to said pedals at two ends thereof and having two chain-like sections respectively engaged with said left and right sprockets, and a cable-like section extending around said first pulleys, said cable-like section being capable of rotating relative to said chain-like sections, said first pulleys guiding said drawing member to reciprocate along a generally U-shaped path, said chain-like sections and said cable-like section of said drawing member being arranged so that reciprocation of said swing arms can be converted into rotation of said left and right sprockets, thereby rotating said driving shaft in said predetermined direction;

a second pulley disposed on said base frame between said swing arms;

a flexible reciprocating element, fastened to said pedals at two ends thereof, extending around said second pulley so that downward movement of either of said pedals can move the other of said pedals upward;

a wheel axle journalled on said base frame;

a wheel body sleeved rigidly on said wheel axle and having a plurality of generally radially extending wheel blades which create air impedance to rotation of said wheel body; and a speed-increasing mechanism interconnecting said wheel axle and said driving shaft so as to rotate said wheel axle at a speed greater than that of said driving shaft.

2. A climber as claimed in claim 1, wherein said speed-increasing mechanism includes a driving sprocket sleeved rigidly on said driving shaft, a driven shaft journalled on said base frame, a driven sprocket sleeved rigidly on said driven shaft and having a diameter smaller than that of said driving sprocket, an endless chain trained on said driving sprocket and said driven sprocket, a driving belt pulley sleeved rigidly on said driven shaft, a driven belt pulley sleeved rigidly on said wheel axle and having a diameter smaller than that of said driving belt pulley, and a V-belt trained on said driving belt pulley and said driven belt pulley.

3. A climber as claimed in claim 1, wherein said wheel axle includes a small wheel sleeved rigidly thereon, and a friction ring sleeved movably on said small wheel, whereby, when said friction ring is moved toward a circumferential surface of said small wheel so as to increase pressure of said friction ring against said small wheel, thereby providing increased resistance of movement of said pedals.

* * * * *